US005817196A

United States Patent [19]

Teracher et al.

[11] Patent Number: 5,817,196

[45] Date of Patent: Oct. 6, 1998

[54] NIOBIUM-CONTAINING HOT-ROLLED STEEL SHEET WITH HIGH STRENGTH AND HIGH DRAWABILITY AND ITS MANUFACTURING PROCESSES

[75] Inventors: Pascal Teracher, Saint Chamas; Jean-Pierre Porcet, FOS sur MER, both of France

[73] Assignee: Sollac (Societe Anonyme), Puteaux, France

[21] Appl. No.: 648,449

[22] Filed: May 15, 1996

[30] Foreign Application Priority Data

Jun. 8, 1995 [FR] France ..... 95 06746

[51] Int. Cl.[6] ..... C21D 8/04; C22C 38/12; C22C 38/14

[52] U.S. Cl. ..... 148/547; 148/654; 148/320

[58] Field of Search ..... 148/320, 328, 148/654, 661, 547

[56] References Cited

U.S. PATENT DOCUMENTS

| | | | |
|---|---|---|---|
| 4,033,789 | 7/1977 | Hamburg et al. | 148/661 |
| 4,141,761 | 2/1979 | Abraham et al. . | |

FOREIGN PATENT DOCUMENTS

| | | |
|---|---|---|
| 0228756 | 2/1987 | European Pat. Off. . |
| 2240960 | 3/1975 | France . |
| 2037350 | 2/1971 | Germany . |
| 236258 | 7/1994 | Germany . |
| 5-179397 | 11/1993 | Japan . |

*Primary Examiner*—Deborah Yee

*Attorney, Agent, or Firm*—Sixbey Friedman Leedom & Ferguson; Thomas W. Cole

[57] ABSTRACT

The subject of the invention is a hot-rolled steel sheet with high strength and high drawability, whose composition, expressed in percentages by weight, is:

$C \leqq 0.12\%$;

$0.5 \leqq Mn \leqq 1.5\%$;

$0 \leqq Si \leqq 0.3\%$;

$0 \leqq P \leqq 0.1\%$;

$0 \leqq S \leqq 0.05\%$;

$0.01 \leqq Al \leqq 0.1\%$;

$0 \leqq Cr \leqq 1\%$;

$0.01 \leqq Nb \leqq 0.1\%$;

$0 \leqq Ti_{eff} \leqq 0.05\%$, $Ti_{eff}$ being the content of titanium not in the form of nitrides, sulfides or oxides; and whose structure comprises at least 75% of ferrite hardened by precipitation of niobium or niobium and titanium carbides or carbonitrides, the remainder of the structure comprising at least 10% of martensite and possibly bainite and residual austenite. The subject of the invention is also processes for manufacturing such sheets.

6 Claims, 1 Drawing Sheet

94356A03.BMP

94356A03.BMP

NIOBIUM-CONTAINING HOT-ROLLED STEEL SHEET WITH HIGH STRENGTH AND HIGH DRAWABILITY AND ITS MANUFACTURING PROCESSES

FIELD OF THE INVENTION

The invention relates to steelmaking. More precisely, it relates to the field of hot-rolled steel sheets which have to have high strength and drawability properties, these being intended especially for the motor-vehicle industry in order to form structural components of vehicles.

PRIOR ART

Within the range of hot-rolled flat products, the mechanical properties of which are obtained by controlled rolling on strip rolling mills, various categories of steels exist which, to various degrees, have mechanical properties which may be termed high.

High yield strength steels (called "HYS steels" or "HSLA") are steels microalloyed with niobium, titanium or vanadium. They have a high yield stress, a minimum of which, depending on the grade, may range from approximately 300 MPa to approximately 700 MPa, this high yield stress being obtained by virtue of refinement of the ferritic grains and a fine hardening precipitation. However, their ability to be formed is limited, most especially for the highest grades. They have a high yield stress/tensile strength ($R_e/R_m$) ratio.

So-called "dual-phase" steels have a microstructure composed of ferrite and martensite. The ferritic transformation is favored by rapid cooling of the sheet, immediately after the end of hot rolling, down to a temperature below $Ar_3$ followed by slow air-cooling. The martensitic transformation is then obtained by rapid cooling to a temperature below $M_S$. For a given strength level, these steels have excellent formability, but this degrades for strengths greater than 650 MPa because of the high proportion of martensite which they contain.

So-called "high-strength" ("HS") steels have a microstructure composed of ferrite and bainite. Their formability is intermediate between that of the high yield stress steels and that of dual-phase steels, but their weldability is inferior to that of both these types of steels. Their strength is limited to the grade $R_m$=600 MPa, because otherwise their formability very quickly decreases.

So-called "ultra-low carbon bainitic-structure" ("ULCB") steels have an extremely fine microstructure of low-carbon bainite composed of ferrite in the form of lamellae and of carbides. In order to obtain it, the ferritic transformation is inhibited by microaddition of boron, or indeed also of niobium. These steels make it possible to achieve very high strengths, greater than 750 MPa, but with quite low formability and quite low ductility.

Finally, TRIP (TRansformation Induced Plasticity) steels have a microstructure composed of ferrite, bainite and residual austenite. They make it possible to achieve very high strengths, but their weldability is very poor because of their high carbon content.

In order to obtain the best possible compromise between strength, formability and also weldability, steels have been developed (see the document EP 0,548,950) for hot-rolled sheets whose structure essentially contains ferrite, hardened by titanium carbide and/or niobium carbide precipitates, and martensite, or indeed also residual austenite. These steels have the composition, expressed in percentages by weight:

$C \leqq 0.18\%$; $0.5 \leqq Si \leqq 2.5\%$; $0.5 \leqq Mn \leqq 2.5\%$; $P \leqq 0.05\%$; $S \leqq 0.02\%$; $0.01 \leqq Al \leqq 0.1\%$; $0.02 \leqq Ti \leqq 0.5\%$ and/or $0.03 \leqq Nb \leqq 1\%$, with $C\% \geqq 0.05+Ti/4+Nb/8$.

These steels have in fact high strengths ($R_m$ is about 700 MPa) and good formability ($R_e/R_m$ is about 0.65). However, their weldability is not as good as would be desired. In addition, their surface appearance is not satisfactory—the presence of a category of defects called "tiger stripes" is observed. These are mill scale encrustations which descaling cannot remove. These defects restrict the possibilities of using the sheets for manufacturing components intended to remain visible.

The object of the invention is to provide users of hot-rolled steel sheets with products having a very good compromise between high strength levels, satisfactory formability and good weldability, as well as a flawless surface appearance.

SUMMARY OF THE INVENTION

For this purpose, the subject of the invention is a hot-rolled steel sheet with high strength and high drawability, whose composition, expressed in percentages by weight, is:

$C \leqq 0.12\%$;

$0.5 \leqq Mn \leqq 1.5\%$;

$0 \leqq Si \leqq 0.3\%$;

$0 \leqq P \leqq 0.1\%$;

$0 \leqq S \leqq 0.05\%$;

$0.01 \leqq Al \leqq 0.1\%$;

$0 \leqq Cr \leqq 1\%$;

$0.01 \leqq Nb \leqq 0.1\%$;

$0 \leqq Ti_{eff} \leqq 0.05\%$, $Ti_{eff}$ being the content of titanium not in the form of nitrides, sulfides or oxides; and whose structure comprises at least 75% of ferrite hardened by precipitation of niobium or niobium and titanium carbides or carbonitrides, the remainder of the structure comprising at least 10% of martensite and possibly bainite and residual austenite.

The subject of the invention is also processes for manufacturing such sheets.

As will have been understood, the sheets according to the invention are distinguished from those known up to now for the same uses by their substantially lower silicon content, their markedly narrow ranges of niobium and titanium contents and stricter requirements with regard to the distribution of the various phases in the structure. Obtaining the structure, and therefore the properties desired for the sheet, involves special conditions during the heat treatment which follows immediately after the hot rolling. Their composition and their method of manufacture mean that these steels represent, in several respects, a combination of HYS steels and dual-phase steels.

DESCRIPTION OF THE PREFERRED EMBODIMENTS

Figure 1:
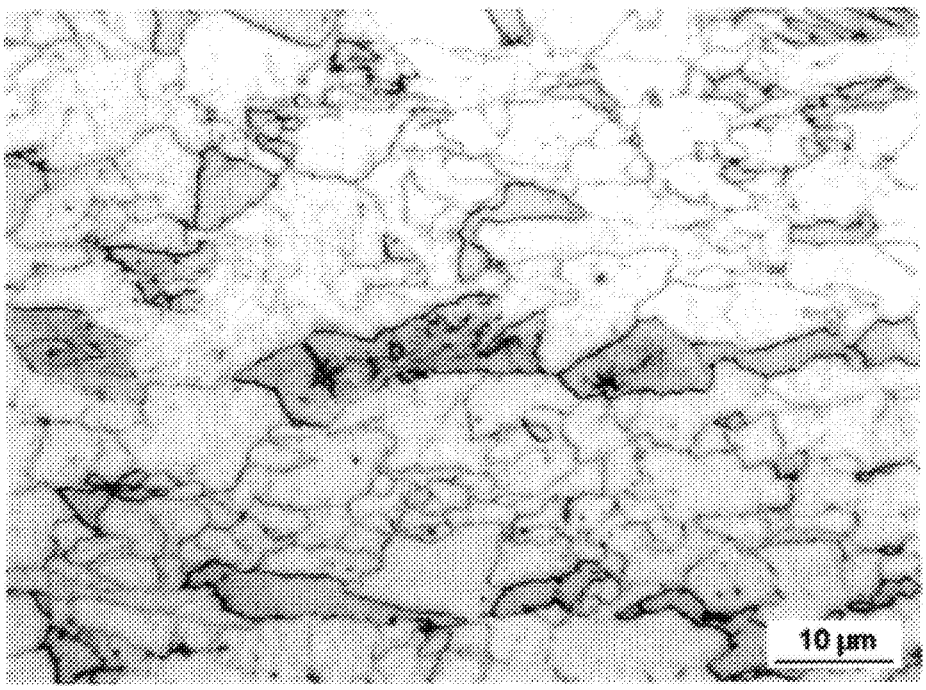
FIG. 1 is a microphotograph illustrating the grain structure of a steel sheet according to the invention having a niobium content of 0.50% by weight and a titanium content of 0.010% by weight, wherein the light areas are equi-axed ferrite and the dark areas are martensite.

In order to obtain hot-rolled sheets according to the invention, it is necessary firstly to smelt, and then to cast in the form of a slab, a steel having a carbon content of less than or equal to 0.12%, a manganese content of between 0.5 and 1.5%, a silicon content of less than or equal to 0.3%, a phosphorus content of less than or equal to 0.1%, a sulfur content of less than or equal to 0.05%, an aluminum content of between 0.01 and 0.1%, a chromium content of less than or equal to 1%, a niobium content of between 0.01 and 0.10% and an effective titanium content (the meaning of this term will be explained later) of between 0 and 0.05% (all the percentages being percentages by weight).

Next, the slab is hot-rolled on a strip rolling mill in order to form a sheet of a few mm in thickness. On leaving the strip rolling mill, the sheet undergoes a heat treatment which makes it possible to confer on it a microstructure composed of at least 75% of ferrite and at least 10% of martensite. The ferrite is hardened by a precipitation of niobium carbides or carbonitrides, and also of titanium carbides or carbonitrides if there is a significant amount of this element present. The microstructure may possibly also include bainite and residual austenite.

The limited carbon content makes it possible to reserve good weldability in the steel and to obtain the desired proportion of martensite.

Manganese plays a hardening role since:

it is in solid solution;

by lowering the $Ar_3$ point, it enables the end-of-rolling temperature to be lowered and a fine ferritic grain structure to be obtained;

it is a hardening element.

However, at high contents it causes the formation of a banded structure and leads to degradation in the fatigue and/or formability performance. It is therefore necessary to limit its presence to a specified maximum content of 1.5%.

Silicon is an alphagenic element, which therefore favors the ferritic transformation. It is also hardening in solid solution. However, the invention relies, inter alia, on a very substantial reduction in the silicon content of the steel compared to the prior art, illustrated by the document EP 0,548,950. The advantage of an appreciable reduction in the silicon content is that the surface appearance problems encountered in steels of the prior art stem, in fact, from appearance at the surface of the slab, in the reheating furnace, of the oxide $Fe_2SiO_4$ which, with the oxide FeO, forms a low melting point eutectic. This eutectic penetrates into the grain boundaries and favors anchoring of the mill scale, which can therefore be removed only incompletely by descaling. Another advantage of this reduction in silicon content is the improvement in the weldability of the steel. As long as the other specifications with regard to their composition and their method of manufacture are complied with, the steels of the invention are tolerant of having only low, or indeed very low, silicon contents.

Like silicon, phosphorus is alphagenic and hardening. However, its content must be limited to 0.1% and may be as low as possible. The reason for this is that it would be likely, at high content, to form mid-thickness segregation which could cause delamination. Moreover, it may segregate at the grain boundaries, which increases brittleness.

Although not strictly speaking necessary, the addition of chromium (limited to 1%) is recommended since it favors the formation of martensite and the ferritic transformation.

Niobium and titanium are microalloy elements which form ferrite-hardening carbide and carbonitride precipitates. Their addition, which for titanium is only optional, has the purpose of obtaining, by virtue of this hardening, a high strength level.

A very special feature of the composition of the steels according to the invention is the presence of niobium, although this element is not usually added when it is desired to obtain a structure of the ferrite/martensite dual-phase type. The reason for this is that niobium increases the temperature of non-recrystallization of the steel, which results in a high work-hardening of the austenite and may lead to non-uniformity in the size of the grains. In addition, precipitation of niobium carbides and carbonitrides slows down the ferritic transformation. This is why, in order to form sufficient suitably hardened equi-axed ferrite in the presence of niobium, it is absolutely essential to comply with one of the hot-rolled sheet cooling schemes which will be described.

With regard to the optional addition of titanium, the ferrite-hardening effect which it provides is, however, obtained only if the titanium has the possibility of combining with the carbon. It is therefore necessary to take into account, when adding titanium to the pool of liquid steel, the possibilities of forming titanium oxides, nitrides and sulfides. Significant formation of oxides may be easily avoided by adding aluminum during the deoxidation of the liquid steel. As far as the quantities of nitrides and sulfides formed are concerned, they depend on the nitrogen and sulfur contents of the liquid steel. Although it is not possible, during smelting and casting, to limit these nitrogen and sulfur contents drastically, it is necessary to add to the metal pool a sufficient quantity of titanium so that, in the solidified metal, after precipitation of the nitrides and sulfides, the content of titanium not in the form of nitrides, sulfides or oxides (and therefore available for forming carbides and carbonitrides) is at most 0.05%. It is this content which is termed "effective titanium content" and which is abbreviated to "$Ti_{eff}$%". When the steel is deoxidized with aluminum, taking into account the thermodynamic equilibria which are established in the metal during solidification, it is possible to estimate that, if $Ti_{total}$% denotes the total titanium content of the steel, then $$Ti_{eff} = Ti_{total\ \%} - 3.4 \times N\% - 1.5 \times S$$

This addition of titanium may advantageously complement the addition of niobium in order to achieve even higher strength levels. However, adding niobium and titanium above the prescribed quantities is to no avail, since there would then be saturation of the hardening effect.

In order to manufacture the sheets according to the invention, various methods of operation may be envisaged, depending on the desired performance level and on the composition of the metal.

According to a first method of operation (No 1), applicable in a standardized way to all the steels of the invention, and more particularly to those whose niobium content is between 0.02 and 0.1%, the sequence of operations is as follows:

1) a steel, whose composition in percentages by weight is:

$C \leqq 0.12\%$;

$0.5 \leqq Mn \leqq 1.5\%$;

$0 \leqq Si \leqq 0.3\%$;

$0 \leqq P \leqq 0.1\%$;

$0 \leqq S \leqq 0.05\%$;

$0.01 \leqq Al \leqq 0.1\%$;

$0 \leqq Cr \leqq 1\%$;

$0.01 \leqq Nb \leqq 0.1\%$;

$0 \leqq Ti_{eff} \leqq 0.05\%$, $Ti_{eff}$ being the content of titanium not in the form of nitrides, sulfides or oxides, is smelted and cast in the form of a slab;

2) said slab is hot-rolled on a strip rolling mill with an end-of-rolling temperature (ERT) lying between the point $Ar_3$ of the grade cast and 950° C.;

3) on leaving the strip rolling mill, the product is cooled in two steps:

Step 1: slow cooling, in air, at a rate of 2° to 15° C./s, carried out between ERT and a temperature called "start-of-quenching temperature" (SQT) lying between 730° C. and the point $Ar_1$ of the grade cast; it is during this cooling that the ferritic transformation takes place; it must not, in the general case, last less than 8 s in order to allow the ferritic transformation (it will be recalled that this transformation is retarded by the presence of niobium carbides and carbonitrides) to take place correctly; this cooling must not last more than 40 s either in order not to end up with too large a size of precipitates which would be to the detriment of the tensile strength of the sheet;

Step 2: quenching, for example carried out by spraying water, at a rate of 20° to 150° C./s between SQT and a temperature called "end-of-cooling temperature" (ECT) which is less than or equal to 300° C.

Once these operations have been performed, the sheet may be coiled, either immediately or after standing in air.

According to a second method of operation (No. 2), also applicable to all the steels of the invention in a standardized manner, and particularly to those whose niobium content is between 0.02 and 0.1%, operations 1) and 2) are the same as before. On the other hand, operation 3) includes no longer two, but three cooling steps, in which:

Step 1: water-quenching at a rate of 20° to 150° C./s, starting less than 10 s after the end of hot rolling, between ERT and an intermediate temperature ($T_{inter}$) below the $Ar_3$ point of the grade; during this operation, the steel remains in the austenitic range;

Step 2: slow air-cooling at a rate of 2° to 150° C./s for a time of greater than 5 s and less than 40 s, between $T_{inter}$ and SQT, which is between the $Ar_1$ point of the grade and 730° C.; the ferritic transformation takes place during this step, and here too the purpose of fixing a minimum time for the cooling is to ensure that this transformation occurs correctly despite the presence of niobium;

Step 3: water-quenching at a rate of 20° to 150° C./s, between SQT and ECT, the latter temperature being less than or equal to 300° C.

Next, the sheet may be coiled, here too with or without standing in air beforehand.

In the latter mode of operation, the function of the water cooling of step 1 of operation 3) is to bring the sheet rapidly into the ferritic transformation range. This transformation then starts immediately after the water cooling ceases. It therefore occurs more quickly and at a lower temperature than in the two-step method of operation. This results in:

a more rapid, and therefore more complete, transformation for a given air-cooling time, which itself may be limited by the length of the cooling table;

a smaller ferritic grain size; and a finer and more hardening precipitation of niobium and titanium carbides and carbonitrides.

In the case where the steel has a relatively low niobium content, that is to say one of between 0.01 and 0.02%, fixing a minimum time for the slow air-cooling step of operation 3) for the two methods of operation that have just been described is no longer absolutely essential, the niobium not being present in enough quantity to slow down the ferritic transformation very appreciably.

Thus, a sheet can be produced for which the guaranteed minimum strength may be adjusted between 650 and 750 MPa, with an $R_e/R_m$ ratio of less than 0.8, a work-hardening coefficient of at least 0.13 and a total elongation of at least 15%. The tensile stress-strain curve has no yield-stress plateau, which improves the work-hardening behavior. Finally, the surface appearance of the descaled product has no "tiger stripes". The objectives assigned to the invention are therefore achieved.

By way of example, experiments pertaining to the invention were carried out on the grades of steel mentioned in Table 1 (the titanium contents are total contents; the effective titanium contents must be calculated as explained):

TABLE 1 steel grades tested

| Grade | C % | Mn % | P % | Si % | Cr % | N % | S % | Nb % | Ti % |
|---|---|---|---|---|---|---|---|---|---|
| A (reference) | 0.072 | 0.982 | 0.040 | 0.190 | 0.750 | 0.0059 | 0.0021 | — | — |
| B | 0.079 | 1.210 | 0.015 | 0.180 | 0.021 | 0.0048 | 0.0027 | 0.050 | 0.010 |
| C | 0.080 | 0.990 | 0.040 | 0.200 | 0.750 | 0.0051 | 0.0020 | 0.080 | 0.061 |

These experiments gave the results set out in Table 2, in which t denotes the duration of the air-cooling step during which the ferritic transformation takes place, $R_{p0.2}$ denotes the conventional 0.2% offset yield stress and n the work-hardening coefficient, and in which the "method of cooling" column refers to the two main methods of operation described previously:

TABLE 2

Experimental results

| Grade | Method of cooling | SQT (°C.) | t (s) | $R_{p0.2}$ (MPa) | $R_m$ (MPa) | $R_{p0.2}/R_m$ | n |
|---|---|---|---|---|---|---|---|
| A (reference) | No. 2 | 720 | 15 | 319 | 590 | 0.54 | 0.20 |
| A (reference) | No. 2 | 650 | 15 | 308 | 570 | 0.54 | 0.20 |
| B | No. 1 | 630 | 15 | 439 | 675 | 0.65 | 0.16 |
| B | No. 2 | 700 | 15 | 449 | 680 | 0.66 | 0.16 |
| B | No. 2 | 630 | 15 | 445 | 675 | 0.66 | 0.16 |
| C | No. 2 | 720 | 15 | 515 | 765 | 0.67 | 0.14 |
| C | No. 2 | 630 | 15 | 490 | 720 | 0.68 | 0.15 |
| B | No. 1 | 730 | 6 | 550 | 590 | 0.93 | 0.12 |
| B | No. 2 | 720 | 3 | 550 | 620 | 0.89 | 0.12 |

From these results, it may be seen that the addition of niobium and titanium to the reference steel A in grades B and C makes it possible to increase the strength of this steel very substantially, in particular when the method of operation No. 2 having three-step cooling is used, while at the same time maintaining a suitable $R_{p0.2}/R_m$ ratio. It may also be pointed out that, from the last two tests mentioned, the addition of niobium does not have any effect when the sheet is forced to be air cooled for too short a time for the ferritic transformation to be able to take place satisfactorily—the strength is not improved compared to the reference, while the $R_{p0.2}/R_m$ ratio is even substantially inferior. The grade B in question in these two tests is particularly sensitive to this factor since its silicon content is not very high and its phosphorus content is low, and this does not favor the ferritic transformation, and therefore the formation of martensite. The hard phase is then formed from bainite and/or pearlite.

The micrograph of FIG. 1 shows the structure of a steel corresponding to grade B with 0.050% of niobium and 0.010% of titanium. After hot rolling, the sheet was cooled according to the method of operation No. 2. The light areas are equi-axed ferrite and represent 85% of the structure. The dark areas are martensite and represent virtually all the remainder of the structure.

The steels according to the invention may be employed especially for forming structural components of motor vehicles, such as chassis elements, wheel bodies, suspension arms, as well as any pressed components which have to have a high resistance to mechanical stresses.

We claim:

1. A hot-rolled steel sheet with high strength and high drawability, whose composition, expressed in percentages by weight, is:

$C \leqq 0.12\%$;

$0.5 \leqq Mn \leqq 1.5\%$;

$0 \leqq Si \leqq 0.3\%$;

$0 \leqq P \leqq 0.1\%$;

$0 \leqq S \leqq 0.05\%$;

$0.01 \leqq Al \leqq 0.1\%$;

$0 \leqq Cr \leqq 1\%$;

$0.01 \leqq Nb \leqq 0.1\%$;

$0 \leqq Ti_{eff} \leqq 0.05\%$, $Ti_{eff}$ being the content of titanium not in the form of nitrides, sulfides or oxides;

and whose structure comprises at least 75% of ferrite hardened by precipitation of Nb or Nb and Ti carbides or carbonitrides, the remainder of the structure comprising at least 10% of martensite and possibly bainite and residual austenite, said steel sheet having a minimum tensile strength of between about 650–750 MPa, a minimum yield strength of between about 439–550 MPa, an Re/Rm ratio of less than 0.8, a work hardening coefficient of at least 0.13 and a total elongation of at least 15%, said steel sheet also having uniform color characteristics throughout its area.

2. The steel sheet as claimed in claim 1, wherein its Nb content is between 0.010 and 0.020%.

3. A process for manufacturing a hot-rolled steel sheet with high strength and high drawability,:

casting in the form of a slab a steel whose composition, in weight percentage, is set forth below:

$C \leqq 0.12\%$;

$0.5 \leqq Mn \leqq 1.5\%$;

$0 \leqq Si \leqq 0.3\%$;

$0 \leqq P \leqq 0.1\%$;

$0 \leqq S \leqq 0.05\%$;

$0.01 \leqq Al \leqq 0.1\%$;

$0 \leqq Cr \leqq 1\%$;

$0.01 \leqq Nb \leqq 0.1\%$;

$0 \leqq Ti_{eff} \leqq 0.05\%$, $Ti_{eff}$ being the content of titanium not in the form of nitrides, sulfides or oxides; and whose structure comprises at least 75% of ferrite hardened by precipitation of Nb or Nb and Ti carbides or carbonitrides, the remainder of the structure comprising at least 10% of martensite and possibly bainite and residual austenite;

hot-rolling said slab into the form of a sheet, completing the rolling at a temperature of between the $Ar_3$ point and 950° C.;

slow-cooling said sheet at a rate of 2° to 15° C./s for a time of between 8 and 40 s down to a temperature of between the $Ar_1$ point and 730° C.;

quenching said sheet at a rate of 20° to 150° C./s down to a temperature less than or equal to 300° C.

4. The process for manufacturing a hot-rolled steel sheet with high strength and high drawability, wherein:

a steel whose composition is in accordance with that of the sheet as claimed in claim 3 is smelted and cast in the form of a slab;

said slab is then hot-rolled into the form of a sheet, completing the rolling at a temperature of between the $Ar_3$ point and 950° C.;

less than 10 s after the end of hot rolling, said sheet is then quenched at a rate of 20° to 150° C./s down to a temperature below the $Ar_3$ point;

said sheet is then slow-cooled at a rate of 2° to 15° C./s for a time of between 5 and 40 s down to a temperature of between the $Ar_1$ point and 730° C.; and said sheet then is quenched at a rate of 20° to 150° C./s down to a temperature less than or equal to 300° C.

5. The process for manufacturing a hot-rolled steel sheet with high strength and high drawability, wherein:

a steel whose composition is in accordance with that of the sheet as claimed in claim 3 with an Nb content between 0.010 and 0.020 is smelted and cast in the form of a slab;

said slab is then hot-rolled into the form of a sheet, completing the rolling at a temperature of between the $Ar_3$ point and 950° C.;

said sheet is then slow-cooled at a rate of 2° to 15° C./s for a time of between 5 and 40 s down to a temperature of between the $Ar_1$ point and 730° C.; and said sheet is then quenched at a rate of 20° to 150° C./s down to a temperature less than or equal to 300° C.

6. The process for manufacturing a hot-rolled steel sheet with high strength and high drawability, wherein:

a steel whose composition is in accordance with that of the sheet as claimed in claim 3 with an Nb content between 0.010 and 0.020 is smelted and cast in the form of a slab;

said slab is then hot-rolled into the form of a sheet, completing the rolling at a temperature of between the $Ar_3$ point and 950° C.;

less than 10 s after the end of hot rolling, said sheet is then quenched at a rate of 20° to 150° C./s down to a temperature below the $Ar_3$ point;

said sheet is then slow-cooled at a rate of 2° to 15° C./s for a time of less than 40 s down to a temperature of between the $Ar_1$ point and 730° C.; and said sheet is then quenched at a rate of 20° to 150° C./s down to a temperature less than or equal to 300° C.

* * * * *